US005421562A

United States Patent [19]

Vander Jagt

[11] Patent Number: 5,421,562

[45] Date of Patent: Jun. 6, 1995

[54] GAS-SHIELDED SIPHONIC VALVE

[75] Inventor: A. Dean Vander Jagt, Essexville, Mich.

[73] Assignee: General Motors Corporation, Detroit, Mich.

[21] Appl. No.: 233,916

[22] Filed: Apr. 28, 1994

[51] Int. Cl.[6] ..... B22D 41/58

[52] U.S. Cl. ..... 266/209; 266/239; 222/591; 222/603

[58] Field of Search ..... 266/208, 209, 211, 239; 222/591, 603

[56] References Cited

U.S. PATENT DOCUMENTS

| | | | |
|---|---|---|---|
| 916,314 | 3/1909 | Hitt | 266/239 |
| 1,944,733 | 1/1934 | Doerschunk et al. | 266/239 |
| 2,397,512 | 4/1946 | Schwartz et al. | 266/239 |
| 3,310,850 | 3/1967 | Armbruster | 22/73 |
| 3,552,478 | 1/1971 | Lauener | 164/64 |
| 4,143,674 | 3/1979 | Portalier | 137/151 |
| 4,425,932 | 1/1984 | Herman | 137/143 |
| 4,538,670 | 9/1985 | LaBate | 164/475 |
| 4,805,688 | 2/1989 | Foulard et al. | 164/475 |
| 4,949,885 | 8/1990 | Struble et al. | 222/590 |

OTHER PUBLICATIONS

"Chemical Engineers'" Handbook, Prepared by a staff of specialists, John H. Perry, Editor, McGraw-Hill Book Co., Inc., Dec. 1950—p. 954.

"Auto-Siphon", Stahl Specialty Company, Kingsville, Mo. 64061.

"Autoladle®", Lindberg/MPH, a General Signal Company, Riverside, Mich. 49084, Copyright Dec. 1989, Bulletin 69122 Rev. 1 3M/789/KC Printed in USA.

*Primary Examiner*—Scott Kastler

*Attorney, Agent, or Firm*—Lawrence B. Plant

[57] ABSTRACT

A gas-shielded siphonic valve for controlling the flow of molten metal from one vessel to another. The valve includes a hollow conduit extending between the vessels above the surfaces of the metal therein with opposite ends thereof immersed in the metal in both vessels. An exhaust port permits evacuation of the inside of the conduit sufficiently to draw enough metal up into the conduit to effect a siphoning action between the vessels. A housing surrounding the conduit defining a chamber about the conduit for holding an inert gas. Any leaks in the system will neither break the siphoning action nor contaminate the metal. Varying the amount of vacuum applied to the system can be used to control the rate of flow of metal therethrough.

7 Claims, 3 Drawing Sheets

GAS-SHIELDED SIPHONIC VALVE

This invention relates to a siphon for controlling the flow of molten metal from one vessel to another, and more particularly to a siphon which is shielded from air intrusion and capable of starting, stopping and/or modulating the flow rate of metal between the vessels.

BACKGROUND OF THE INVENTION

It is well known in the foundry industry to siphonically transport molten metal from one vessel to another. Siphons for this purpose comprise essentially a pipe having an inlet end submerged in the molten metal in a supply vessel and an outlet end submerged in the molten metal in a receiving vessel, wherein the surface of the metal in the receiving vessel is lower than the surface of the metal in the supply vessel. The vessels may have a variety of specific uses including such specific applications as furnaces, ladles, tundishes, launders, holding pots, and like typically found in a foundry.

Intrusion of air into a siphon is troublesome as it can "break" the siphon causing interruption in the flow of metal between the vessels, and it can react with the molten metal forming undesirable inclusions in castings formed therefrom. Because of its high reactivity, this later problem is particularly troublesome when handling molten aluminum.

Siphons have heretofore been made from refractory ceramic materials (e.g., ceramic-lined metal pipes). Refractory ceramics tend to be somewhat porous, and hence susceptible to the passage of air therethrough especially when a pressure drop exists between the inside and the outside of the siphon. Moreover, flowing metals, e.g., aluminum, are erosive and corrosive of both refractory ceramics and the typical metal pipes (e.g., cast iron) that encase them. Hence over time, siphons used heretofore develop air leaks which necessitate their frequent repair or replacement. Moreover, any joints that might be formed in multi-part siphons are likewise susceptible to air leakage for the same reasons as set forth above as well as may result from thermal expansion and contraction of the materials. It would be desirable to provide a siphon having a prolonged useful life and one which insures continuous metal flow of uncontaminated metal sufficient to complete a given pouring cycle once it has begun.

It has been suggested to mechanically raise and/or lower the height of a siphon pipe relative to the level of the liquid being siphoned to vary the flow rate of the liquid being siphoned. More typically however, in foundries at least, once the flow has been initiated the flow rate is not controlled, but rather determined only by the natural forces acting on the system such as the difference between the levels of the metal in the supply vessel and the receiving vessel, and the fixed height of the siphon above the level of metal in the supply vessel. It would be desirable to have a siphon which could be readily used to modulate the flow between one vessel and another.

It is a principle object of the present invention to provide a siphonic valve for controlling the flow of molten metal from one vessel to another which valve will continue to operate and deliver uncontaminated metal regardless of leakage of gas into the valve, and which is capable of readily turning on/off or modulating the flow of molten metal between the two vessels without introducing any contaminants into the metal.

These and other objects and advantages of the present invention will become more readily apparent from the detailed description thereof which follows.

BRIEF DESCRIPTION OF THE INVENTION

In its simplest form, the present invention comprehends a siphonic valve comprising a hollow conduit extending between supply and receiving vessels, which conduit has its opposite ends adapted to extend beneath the surfaces of the metal in the vessels. The conduit includes an exhaust port opening to the hollow in the conduit for applying a vacuum to the hollow sufficient to lift molten metal into the conduit from the underlying vessel(s). The conduit is enclosed by a housing which surrounds the conduit in such a manner as to provide a space between the conduit and the housing which is filled with an inert gas via an inlet provided for that purpose. The gas-shielded siphonic valve of the present invention controls (i.e., on/off or modulates) the flow of molten metal between the vessels by application of more or less vacuum to the siphon tube. More specifically, the siphonic valve comprises a hollow body which extends between the vessels above the surfaces of the metal in the vessels and defines a hollow therein. The hollow has an inlet end and an outlet end. A supply tube which is open to the first end of the hollow depends from the body to beneath the surface of the metal in the vessel that supplies the molten metal (i.e., the supply vessel). A discharge spout which is open to the second end of the hollow depends from the body to beneath the surface of the metal in the vessel which receives (i.e., receiving vessel) the molten metal from the supply vessel. The body includes an exhaust port which is open to the hollow in the conduit for applying a vacuum to that hollow which is sufficient to lift molten metal from at least one of the vessels to a level within the hollow sufficient for such metal to bridge the space between the supply tube and the discharge spout and permit metal to flow therebetween. The hollow body is completely enclosed in a housing which defines a chamber between the body and the housing which is adapted to be filled with an inert gas via an inlet thereto.

In accordance with a preferred embodiment of the invention, both the supply tube and the discharge spout are also enclosed in a sleeve and sheath respectively so as to provide a space between the tube and sleeve, and a region between the spout and the sheath which are slightly pressurized with inert gas (e.g., nitrogen). The gas pressurizing the space between the tube and sleeve and the region between the spout and sheath will preferable come from the chamber between the hollow body and the housing via a passageway communicating the space/region with the chamber. Most preferably, the siphonic valve of the present invention will also include a heater for heating the metal in the hollow body to keep it from chilling. The heater will preferably extend directly into the hollow defined by the body.

Operationally, sufficient vacuum is applied to the hollow to draw metal thereinto to start the siphoning process. To finish the siphoning process, the vacuum is released and inert gas introduced into the hollow to break the siphon and stop metal flow. Moreover, the intensity of the vacuum applied to the exhaust port may be varied so as to increase or decrease the level of the liquid metal in the hollow defined by the hollow body, and thereby change the flow rate of the metal between the vessels. In this regard and most preferably, the cross-sectional area of the hollow within the body will increase exponentially (i.e., nonlinearly) moving vertically upwards from the bottom of this hollow to about the mid-point thereof so as to exponentially change the volumetric rate of flow of the metal moving through the hollow as the level of metal in such hollow changes with the varying vacuum. The cross section of the hollow will preferably have either a circular or truncated triangular shape with the walls of the triangle converging toward the bottom of the hollow. The exhaust port is connected to a modulatable source of vacuum capable of varying the vacuum applied to the hollow sufficiently to vary the level of the metal in the hollow, and thereby vary the rate at which metal moves through the hollow. Vacuum modulation may be effected by an appropriate modulating valve between the vacuum source and the siphon, or by means of a variable source of such vacuum (e.g., a variable vacuum pump).

In the event a leak were to occur in the conduit, metal flow would continue to flow so long as the vacuum applied to the conduit were sufficient to prevent the leak from "breaking" the siphon. Moreover, since the conduit is surrounded by an inert gas, any leak in the conduit would only draw inert gas into contact with the molten metal which would not result in the formation of undesirable inclusions in the metal.

BRIEF DESCRIPTION OF THE DRAWINGS

The invention will better be understood when considered in the light of the following description of certain specific embodiments thereof which is given hereafter in conjunction with the several Figures in which:

FIGS. 1 and 2 illustrate one embodiment of the present invention wherein two vessels 4 and 6 are in flow communication one with the other via a gas-shielded siphonic valve 2. One vessel 4 supplies the other vessel 6 with a molten metal 8. The siphonic valve 2 "controls" the flow of metal 8 between the vessels 4 and 6 in the sense that it either starts/stops, or modulate such flow as will be described hereinafter in conjunction with the operation of the valve 2. The siphonic valve 2 comprises an elongated hollow body in the form of a box 10 which straddles the exterior walls 12 and 14 of vessels 6 and 4 respectively and which separate the supply vessel 4 from the receiving vessel 6. The box 10 comprises a steel shell 20 having a refractory ceramic lining 22, and is covered by a lid 24 having a steel shell 26 and refractory lining 28. Flanges 30 and 32 on the box 10 and lid 24 respectively facilitate bolting of the box 10 and lid 24 tightly together. A refractory ceramic supply pipe 16 depends from one end of the box 10 into the supply vessel 4, and a refractory ceramic discharge spout 18 depends from the other end of the box 10 into the receiving vessel 6. The box 10 is encased in an outer steel housing 34 having a cover 36 secured thereto and together define a sealed chamber 38 intermediate the box 10 and housing 34 which is filled with inert gas (e.g., nitrogen). An exhaust pipe 40 extends through the cover 36 of the housing 34 and lid 24 of the box 10 and opens into the hollow 42 of the box 10. At its other end, the exhaust pipe 40 connects to a source of vacuum (not shown) via a two-way valve 43.

Figure 1:
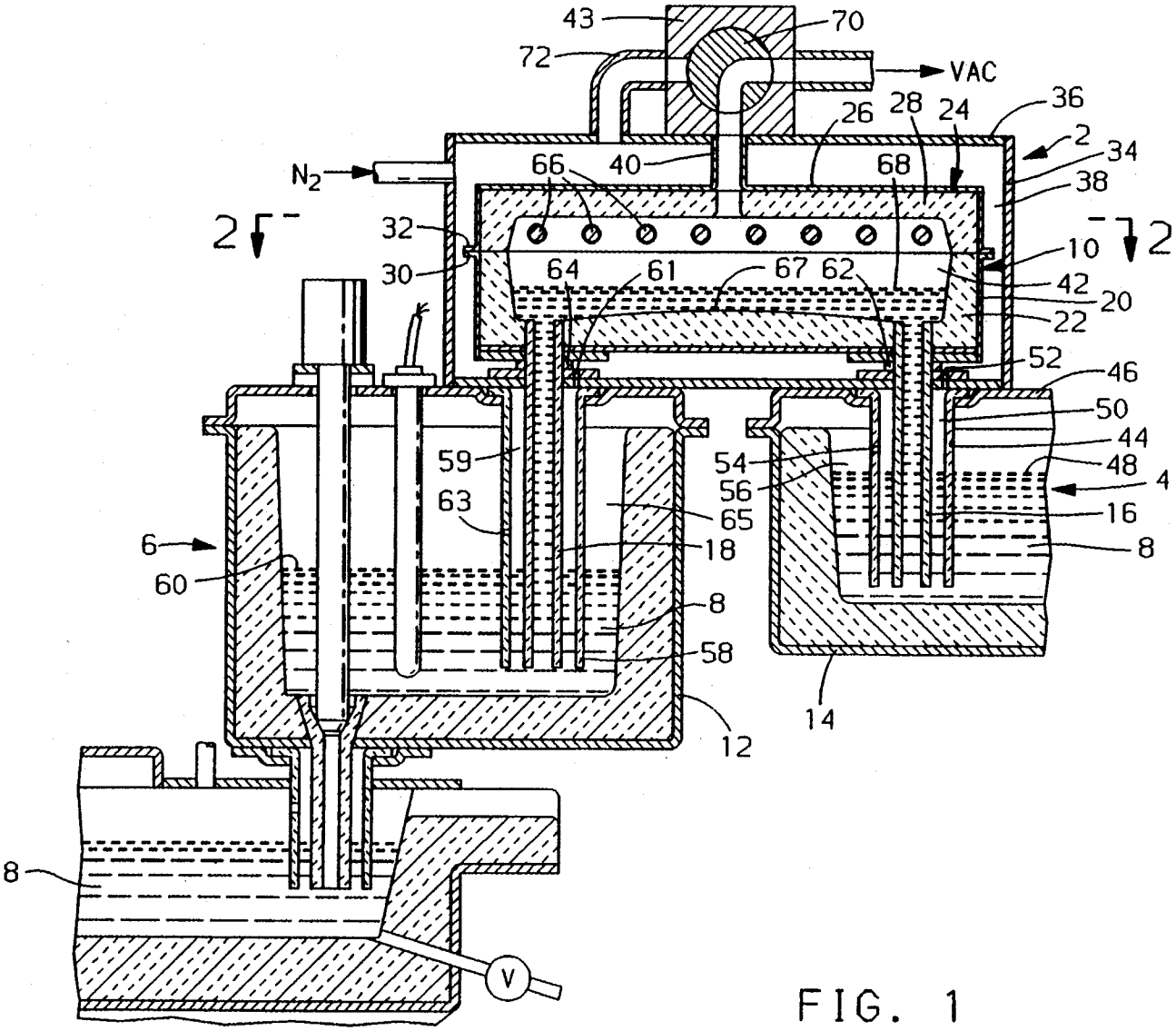
FIG. 1 is a sectioned, side elevational view of one embodiment of the present invention.

The supply tube 16 depends from the box 10 down through a refractory ceramic sleeve 44 depending from the cover 46 of the supply vessel 4. Both the supply tube 16 and its surrounding sleeve 44 extend below the surface 48 of the molten metal 8 in the supply vessel 4 so that the supply tube 16 can draw uncontaminated metal from beneath such surface 48. The sleeve 44 need only extend to just beneath the surface 48 of the metal 8 (i.e., at its lowest point) which need not necessarily be as deep as the tube 16. The annular region 50 between the concentric tube 16 and the sleeve 44, and above the surface 48 of the metal in such region is filled with an inert gas. The inert gas may be provided from any source thereof, but is preferably taken from the slight pressurized chamber 38 via an aperture 52 in the bottom of the housing 34. A vent hole 54 in the sleeve 44 permits excess inert gas to escape from the region 50 into the space 56 above the metal 8 in the supply vessel 4.

A refractory ceramic discharge spout 18 depends from the other end of the box 10 through a refractory ceramic sheath 58 to below the surface 60 of the metal 8 in the receiving vessel 6 for delivering metal to the receiving vessel 6 below such surface 60. The annular region 59 between the spout 18 and sheath 58 is filled with inert gas. The inert gas may be provided from any source thereof, but is preferably taken from the chamber 38 via an aperture 61 in the bottom of the housing 34. A port 63 in the sheath 58 permits excess inert gas to escape from the region 59 into the space 65 above the metal 8 in the receiving vessel 6. Ceramic sealing gaskets 62 and 64 seal the joints between the housing 34, the supply and discharge tubes 16 and 18, and the box 10. Radiant heaters 66 maintain the metal in the box 10 at a desired temperature and may extend transverse the box 10 (as shown) or lengthwise thereof. The heaters 66 will preferably extend into the hollow 42 (as illustrated) for most efficient operation (i.e., less heat loss), but may alternatively extend in the chamber 38 and exteriorly heat the box 10.

In operation, a low level, controlled vacuum is drawn on the hollow 42 via the exhaust pipe 40 which draws molten metal 8 up into the hollow 42 to a desired level 68 sufficient to bridge the space between the supply pipe 16 and the discharge spout 18 at the opposite ends of the hollow 42. When so bridged and so long as the level 60 of the metal in the receiving vessel 6 is lower than the level 48 in the supply vessel 4, metal will flow between the vessels. Metal flow will automatically cease when the level of the metal in the vessel 6 reaches the level in the supply vessel 4. Prior to that time, however, the siphonic valve 2 controls the flow of metal in either a simple on-off mode, or by modulating the flow of metal through the hollow 42. For example, at any time that an operator (or automatic control system) wishes to stop flow between the vessels, the vacuum is released and nitrogen admitted into the exhaust pipe 40 to break the siphon without contaminating the metal 8. This is conveniently facilitated by means of a two-way valve 43 connected to the exhaust pipe 40. Rotation of the valve core 70 in one direction (as illustrated) connects the exhaust pipe 40 to a vacuum source (VAC), while rotation in the other direction (i.e., 90° clockwise) connects the exhaust pipe 40 to the heated, pressurized nitrogen in the chamber 38 between the box 10 and the housing 34 via pipe 72. The refractory 22 will preferably be crowned 67 in the center, or near the ends, to provide a cleaner shut off of the metal flow. By keeping the hollow 42 under an adequate vacuum at all times, a small leak in the system will not break the siphon or contaminate the metal. In this regard, the applied vacuum will be sufficient to overcome the tendency for the leak to "break" the vacuum, and any nitrogen that may be drawn into the system will not contaminate the metal.

The siphonic valve 2 of the present invention can also be used to modulate the flow of metal between the chambers 4 and 6. In this regard, varying the amount of vacuum applied to the pipe 40 will increase or decrease the level 68 of the metal in the hollow 42. So varying the level 68 of the metal will vary the volumetric flow rate through the hollow 42 at least up to the point where the cross-sectional area of the metal in the chamber 42 (i.e., transverse to the direction of metal flow) is equal to, or slightly greater than, the cross-sectional area of the smaller of the supply pipe 16 or discharge spout 18.

Figure 2:
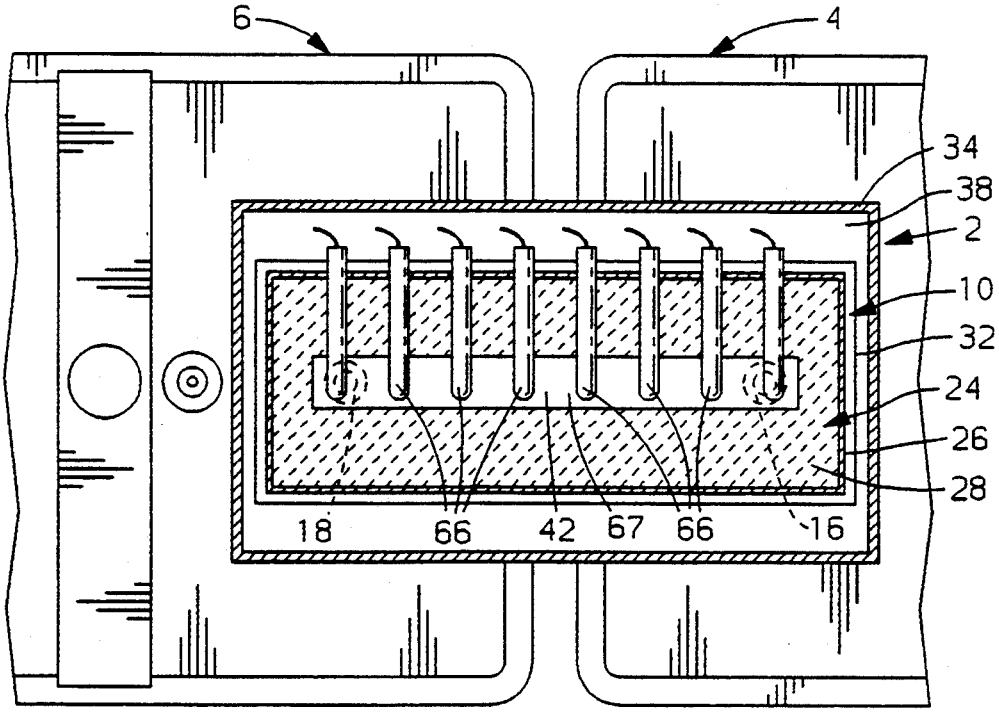
FIG. 2 is a view in the direction 2—2 of FIG. 1.
Figure 3:
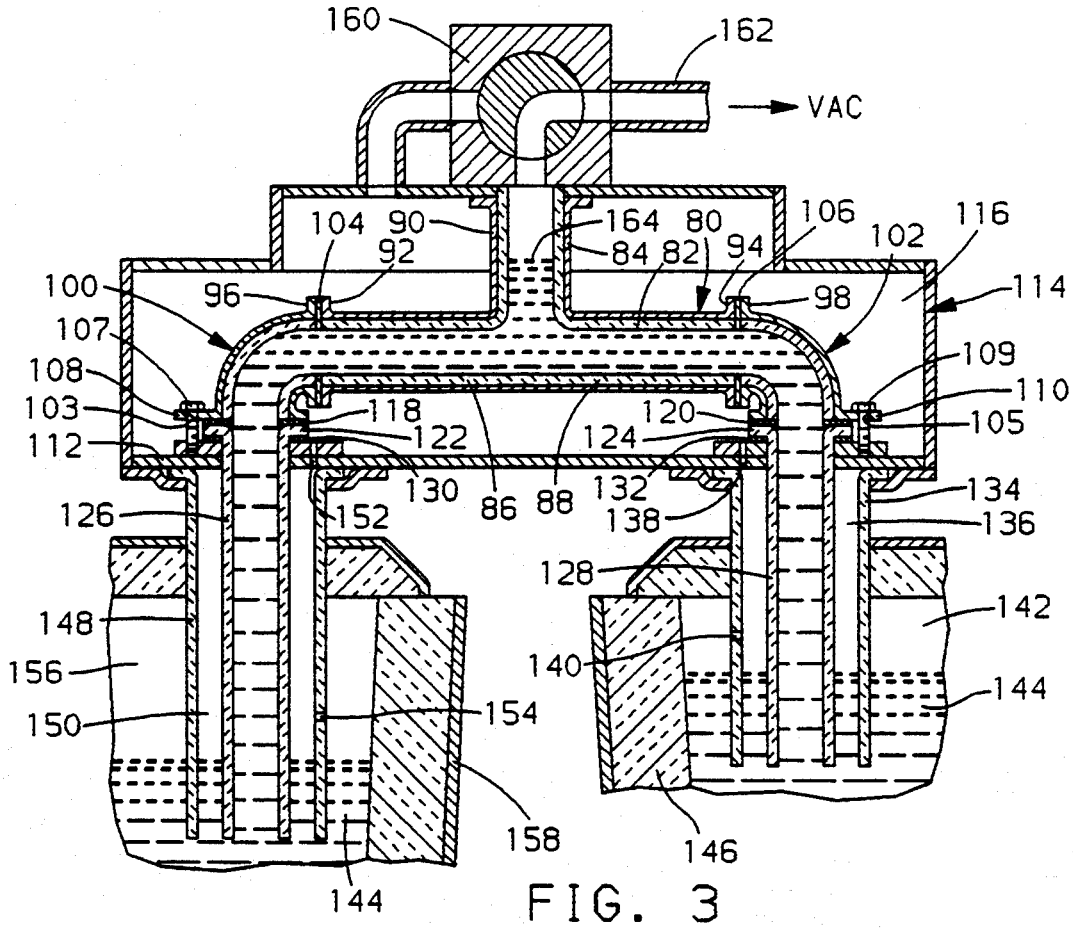
FIG. 3 is a sectioned, side elevational view of another embodiment of the present invention.

FIG. 3 depicts another embodiment of the present invention wherein the hollow body 80 comprises an iron pipe 84 lined with refractory ceramic 82. The body 80 has lateral legs 86 and 88 and an upstanding leg 90 in what is essentially a pipe fitting known as a "tee". The ends of the legs 86 and 88 have flanges 92 and 94, respectively, thereon which mate with, and are bolted to, flanges 96 and 98 of ceramic-lined pipe elbows 100 and 102. Refractory ceramic gaskets 104 and 106 separate the flanges from each other, and seal the joints therebetween. Flanges 108 and 110 on the elbows 100 and 102, respectively, are bolted to the floor 112 of the housing 114 which surrounds the hollow body 80. Bolt holes 103 and 105 in the flanges 108 and 110 are larger in diameter than the shafts of the bolts 107 and 109 that pass therethrough in order to allow some lateral movement of the assembly to accommodate any thermal expansion or contraction of the body 80. A housing 114 encloses the body 80 and defines a chamber 116 between it and the body 80 for containing low pressure nitrogen as discussed above in connection with the embodiment shown in FIG. 1. Gaskets 118 and 120 seal the ends of the elbows 100 and 102 to flanges 122 and 124 of the ceramic discharge spout 126 and ceramic supply tube 128, respectively. Similar gaskets 130 and 132 seal the flanges 122 and 124 of the spout 126 and tube 128, respectively, to the bottom 112 of the housing 114 as shown. A ceramic sleeve 134 surrounds the supply tube 128 and defines a space 136 therebetween which is filled with nitrogen via an aperture 138 extending between the chamber 116 and the space 136. An exhaust port 140 in the sleeve 134 permits excess nitrogen to escape into the space 142 above the molten metal 144 in the supply vessel 146. A ceramic sheath 148 surrounds the discharge spout 126 and defines a region 150 therebetween for containing pressurized nitrogen provided thereto via aperture 152 extending between the chamber 116 and the region 150. An exhaust port 154 in the sheath 148 permits the escape of the nitrogen into the overhead space 156 above the molten metal 144 in the receiving vessel 158. As discussed in conjunction with FIGS. 1 and 2, a two-way valve 160 is used to control the turning on and off of the siphonic valve. Coupling of the pipe 162 to a modulated source of vacuum permits raising or lowering the level 164 of the metal in the hollow body 80 for modulating the flow of the metal therethrough as discussed above in conjunction with FIGS. 1 and 2.

Figure 4:
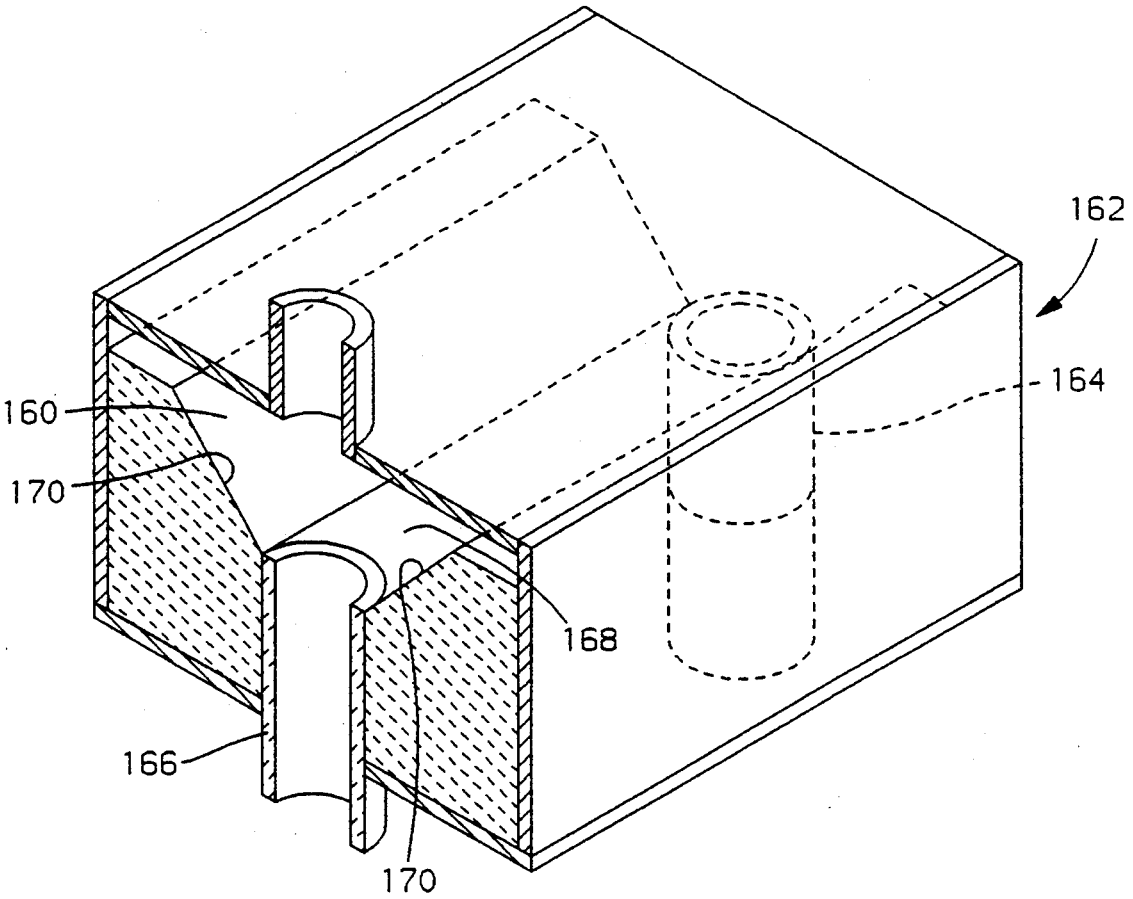
FIG. 4 is a sectioned, perspective view of still another embodiment of the present invention.
Figure 5:
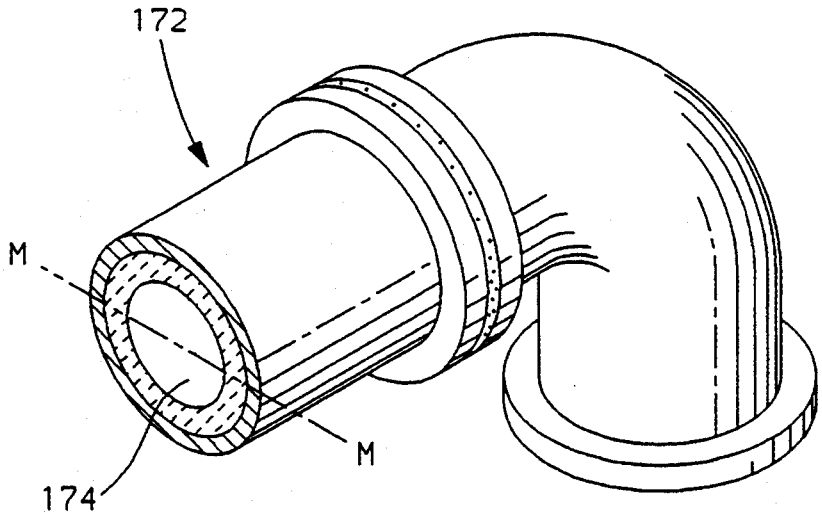
FIG. 5 is a perspective view of a portion of the siphonic valve of FIG. 3.

FIGS. 4 and 5 are perspective views of two different hollow body structures in accordance with the present invention wherein the cross-sectional area of the hollow changes rapidly as one moves vertically from the bottom of such hollow to at least about the mid-point of the hollow (e.g., for the circular hollow). Hence for example, in FIG. 4, the hollow 160 in the body 162 is essentially a truncated V-shaped trough defined by sloping sidewalls 170 which converge toward the floor 168 of the trough. Supply pipe 164 and discharge spout 166 intersect the floor 168 of the trough at opposite ends thereof. Because of the sloping sidewalls 170 of the V-shaped trough, the cross-sectional area of the metal flowing therethrough (and hence the flow rate through the trough) increases significantly as the height of the metal in the trough increases at least up until the cross-sectional area of the smaller of the tube 164 or spout 166 becomes the flow limiting factor. Hence, slight changes in the vacuum applied to the hollow 160 results in slight changes in the height of the metal in the trough, but which in turn results in a more significant change in the flow rate of the metal through the trough. Similarly, FIG. 5 shows a hollow body 172 having a hollow 174 therein with a circular cross section. Slight changes in the vacuum applied to the hollow 174 will cause the metal in the hollow 174 to rise slightly but the cross-sectional area thereof to increase greatly (i.e., at least up till the horizontal mid-point M of the hollow 174 is reached), and then more slowly thereafter.

While the invention has been disclosed primarily in terms of certain specific embodiments thereof, it is not intended to be limited thereto, but rather only to the extent set forth hereafter in the claims which follow.

The embodiments of the invention in which an exclusive property or privilege is claimed is defined as follows:

1. A gas-shielded siphonic valve for controlling the flow rate of oxygen-sensitive molten metal from one vessel to another comprising:

a. a conduit extending between said vessels above the surfaces of the metal in said vessels, said conduit having first and second ends and a continuous hollow therebetween;

b. a first of said ends adapted to extend beneath the surface of said metal in one of said vessels;

c. a second of said ends adapted to extend beneath the surface of said metal in the other of said vessels;

d. an exhaust port in said conduit open to said hollow for applying a vacuum to said hollow sufficient to lift said metal from at least one of said vessels to a level within said hollow sufficient to cause said metal to flow between said vessels when said surface of said metal in said one vessel is higher than said surface of said metal in said other vessel;

e. a housing encasing substantially the entirety of said conduit and defining a chamber between said conduit and said housing;

f. an inlet to said chamber for filling said chamber with inert gas; and g. a modulated source of vacuum connected to said port for so varying the vacuum applied to said hollow as to vary said level of said metal in said conduit and consequently the rate of metal flow through the hollow.

2. A gas-shielded siphonic valve for controlling the flow rate of oxygen-sensitive molten metal from one vessel to another comprising:

a. a hollow body extending between said vessels above the surfaces of the metal in said vessels for transporting said metal between said vessels, said body defining a hollow having first and second ends;

b. a supply tube open to said first end of said hollow and adapted to depend from said body to beneath the surface of said metal in one of said vessels;

c. a discharge spout open to the second end of said hollow and adapted to depend from said body to beneath the surface of said metal in the other of said vessels;

d. a vacuum port open to said hollow for applying a vacuum to such hollow sufficient to lift said metal from at least one of said vessels to a level within said hollow sufficient for said metal in said hollow to bridge the space between said tube and said spout;

e. a housing encasing substantially the entirety of said body and defining a chamber between said body and said housing;

f. a first inlet to said chamber;

g. a source of inert gas connected to said first inlet for filling said chamber with said gas; and h. a modulated source of vacuum connected to said port for so varying the vacuum applied to said hollow as to vary said level of said metal in said body and consequently the rate of metal flow through the hollow.

3. A valve according to claim 2 wherein said supply tube comprises a ceramic and is at least partially encased in a sleeve defining a space between said tube and said sleeve, said space having a second inlet thereto for providing inert gas to said space.

4. A valve according to claim 3 wherein said second inlet is a gas passageway between said space and said chamber.

5. A valve according to claim 2 wherein said discharge spout comprises a ceramic and is at least partially encased in a sheath defining a region between said spout and said sheath, said region having a third inlet thereto for providing inert gas to said region.

6. A valve according to claim 5 wherein said third inlet is a gas passageway between said region space and said chamber.

7. A valve according to claim 2 wherein said hollow is defined in part by a floor having a crown therein situate between said ends.

* * * * *